US005577666A

United States Patent [19]

Shen

[11] Patent Number: 5,577,666

[45] Date of Patent: Nov. 26, 1996

[54] AIR ASSIST ATOMIZER FOR A SPLIT STREAM FUEL INJECTOR

[75] Inventor: Jingming J. Shen, Newport News, Va.

[73] Assignee: Siemens Automotive Corporation, Auburn Hills, Mich.

[21] Appl. No.: 515,475

[22] Filed: Aug. 15, 1995

[51] Int. Cl.[6] ..... F02M 61/00; F02M 61/18

[52] U.S. Cl. ..... 239/290; 239/424.5; 239/417.3; 239/585.4

[58] Field of Search ..... 239/585.1–585.5, 239/290, 424.5, 423, 407, 416.5, 417.3

[56] References Cited

U.S. PATENT DOCUMENTS

| | | | |
|---|---|---|---|
| 5,174,505 | 12/1992 | Shen . | |
| 5,211,341 | 5/1993 | Wieczorek | 239/585.3 |
| 5,402,937 | 4/1995 | Bucholz | 239/585.5 X |
| 5,437,413 | 8/1995 | Shen et al. | 239/585.4 X |
| 5,449,120 | 9/1995 | Tani et al. | 239/585.5 X |
| 5,499,769 | 3/1996 | Namiki et al. | 239/585.1 X |

*Primary Examiner*—Kevin Weldon
*Attorney, Agent, or Firm*—Russel C. Wells

[57] ABSTRACT

The atomizer is a cap-shaped shroud that contains a flat stamped metal insert. When assembled onto the nozzle of a fuel injector, the atomizer causes the insert to be axially sandwiched between the shroud's end wall and the exterior end of the nozzle. In the zone of sandwiching, the insert has six channels of circumferential discontinuities that in cooperation with the nozzle end and the shroud's end wall define air assist openings for the assist air to flow radially inwardly toward the injected fuel that has just been injected from the nozzle. The six channels are divided into one set of two each angularly spaced channels that are directed to one of the two axis of fuel flow; another set of two each angularly spaced channels that are directed to the other of the two axis of fuel flow; and two diametrically opposed channels lie along a diameter of the disk that is normal to and bisects a diameter that passes through the two axis of the fuel flow.

9 Claims, 3 Drawing Sheets

AIR ASSIST ATOMIZER FOR A SPLIT STREAM FUEL INJECTOR

FIELD OF THE INVENTION

This invention relates generally to air assist fuel injectors for injecting fuel into the air induction system of an internal combustion engine and particularly to an atomizer that fits over the nozzle of such a fuel injector and serves to convey assist air to promote the atomization of split stream injected fuel that has just left the nozzle.

BACKGROUND AND SUMMARY OF THE INVENTION

Air assist atomization of the liquid fuel injected from the nozzle of a fuel injector is a known technique that is used to promote better preparation of the combustible air/fuel mixture that is introduced into the combustion chambers of an internal combustion engine. A better mixture preparation promotes both a cleaner and a more efficient combustion process, a desirable goal from the standpoint of both exhaust emissions and fuel economy.

The state of the art contains a substantial number of patents relating to air assist atomization technology. The technology recognizes the benefits that can be gained by the inclusion of special assist air passages that direct the assist air into interaction with the injected liquid fuel. Certain air assist fuel injection systems use pressurized air, from either a pump or some other source of pressurization, as the assist air. Other systems rely on the pressure differential that exists between the atmosphere and the engine's induction system during certain conditions of engine operation. It is a common technique to mount the fuel injectors in an engine manifold or fuel rail which is constructed to include assist air passages for delivering the assist air to the individual injectors.

It is known from commonly assigned U.S. Pat. No. 5,220,900 to construct an air assist atomizer in which the definition of the final length of the assist air passage to each fuel injector tip is provided by the cooperative organization and arrangement of two additional parts which form an atomizer assembly disposed between the nozzle of an injector and the wall of a socket that receives the injector. One advantage of that invention is that it adapts an otherwise conventional electrically-operated fuel injector for use in an air assist system without the need to make modifications to the basic injector, and without the need to make special accommodations in the injector-receiving socket other than suitably dimensioning the socket to accept the air assist atomizer.

The air assist atomizer of the present invention is similar to that of my commonly assigned U.S. Pat. No. 5,174,505, entitled "Air Assist Atomizer For Fuel Injector" wherein a single disk is positioned to direct air to the fuel stream as the fuel leaves the injector and my joint commonly assigned U.S. Pat. No. 5,437,413, entitled "Multiple Disk Air Assist Atomizer for Fuel Injector" wherein two or more disks are positioned to direct assist air radially inwardly at locations that are both axially and circumferentially offset from each other. However, as will become apparent from the ensuing description, drawings, and claims, it is distinguished from the air assist atomizer of both U.S. patents.

The present invention is similar to the atomizer disclosed in both the above identified U.S. patents and other earlier prior art in that it comprises a number of air assist openings that are circumferentially spaced apart and that convey assist air radially inwardly toward the ejected fuel; it is distinguished however in that a pair of diametrically opposed air assist openings on a the single disk function to keep separate the dual streams of a split stream fuel injector. The disk is disposed axially sandwiched between and in mutual abutment with the nozzle and the end wall of the shroud to thereby create the air assist openings through which assist air is radially inwardly directed to the ejected fuel that has just left the nozzle. The disk can be advantageously fabricated by conventional stamping technology, and the interior of the shroud can be finished without the ostensibly elaborate measures of some prior art wherein the assist air passages are molded or machined in the shroud to very tightly held tolerances.

Further features, advantages, and benefits of the present invention will be seen in the ensuing description and claims which are accompanied by drawings. These drawings disclose a presently preferred embodiment of the invention according to the best mode contemplated at this time for carrying out the invention.

DESCRIPTION OF THE PREFERRED EMBODIMENT

Figure 1:
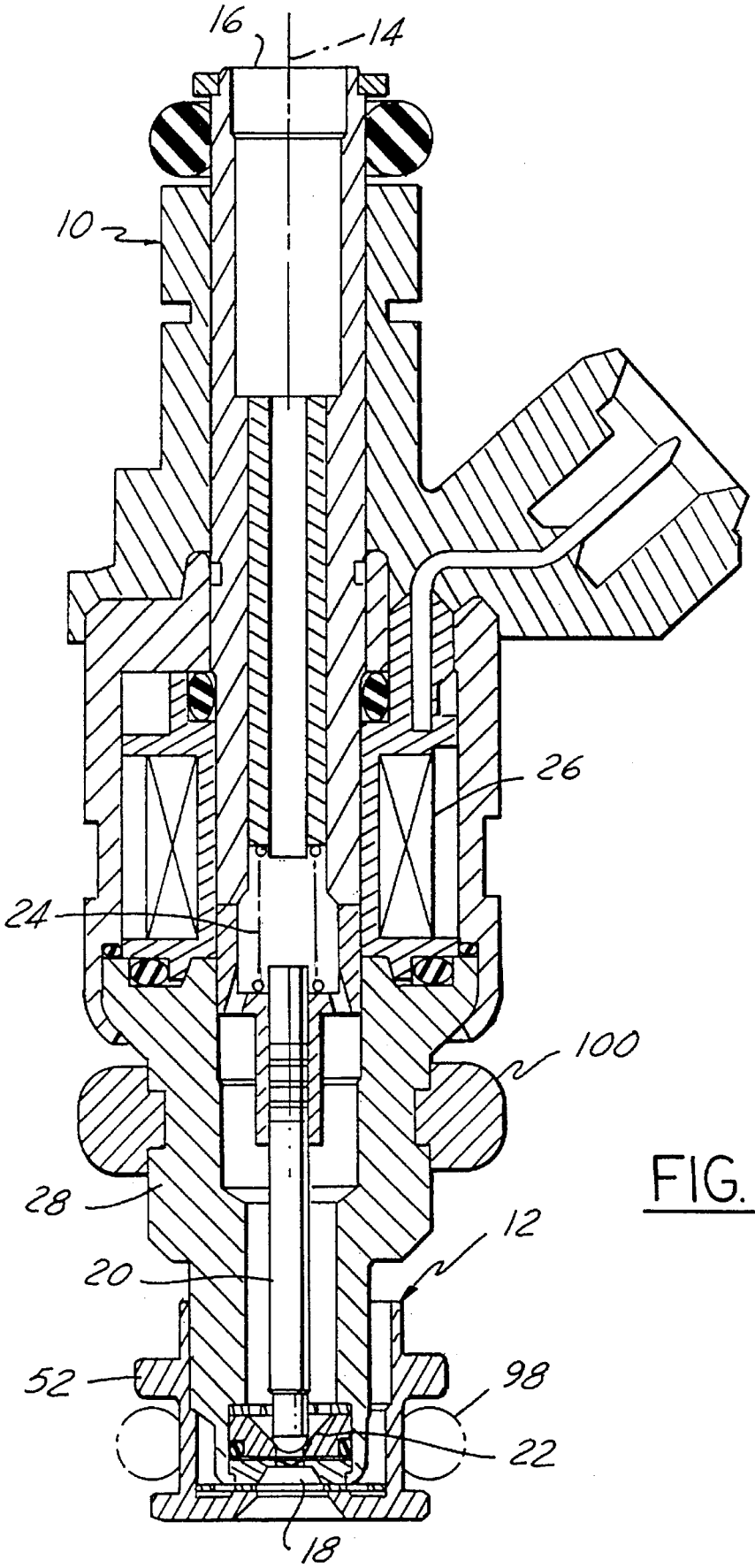
FIG. 1 is a longitudinal cross sectional view through a fuel injector having an air assist atomizer.
Figure 2:
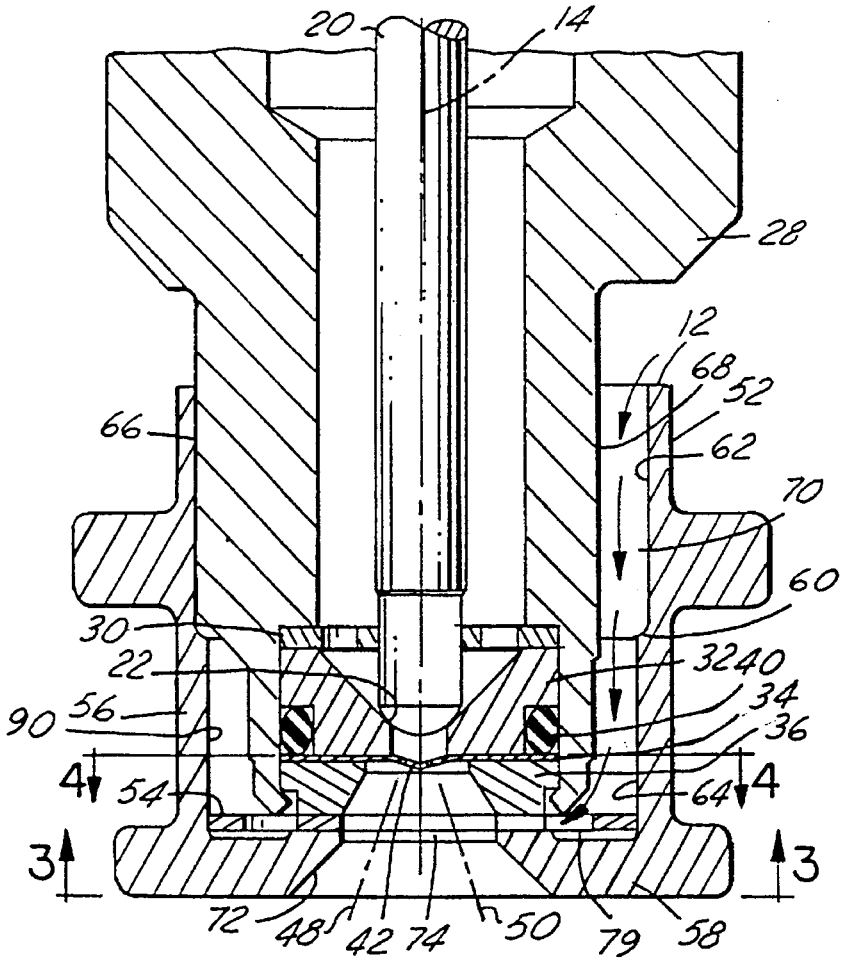
FIG. 2 is an enlarged view of the nozzle end of the fuel injector of FIG. 1.
Figure 3:
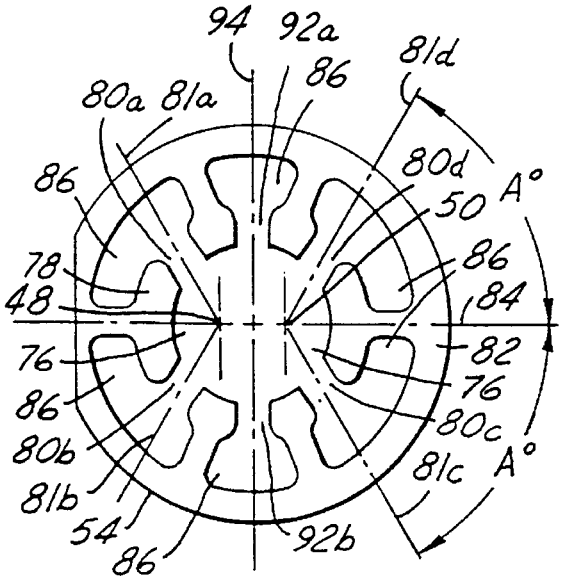
FIG. 3 is a plan view of the atomizer disk of FIG. 2.

FIGS. 1–3 illustrate an electrically operated fuel injector 10 containing an air assist atomizer 12 embodying principles of the invention. The fuel injector 10 has a main longitudinal axis 14 and is a top-feed type device comprising an inlet 16 and a nozzle 18 at its opposite axial ends. The passage of liquid fuel through the fuel injector between the inlet 16 and the nozzle 18 is controlled by the seating and unseating of the rounded tip end of a metal needle 20 on and from a valve seat 22 located just interior of the nozzle 18. The needle 20 is resiliently biased by a spring 24 to seat on the valve seat 22 thereby closing the passage to flow. When the valve is electrically energized by the delivery of electric energizing current to its solenoid coil 26, the needle unseats to allow fuel flow. FIGS. 1 and 2 show the fuel injector closed.

The construction in the vicinity of the nozzle 18 is shown in greater detail in FIG. 2. The fuel injector comprises a generally tubular metal housing 28 which contains in order of assembly at the nozzle end, a metal needle guide member 30, a metal valve seat member 32, a thin disk orifice member 34 made of metal, and a metal retainer member 36. An O-ring seal 40 is disposed between the valve seat member 32 and the inside wall of the housing 28. The thin disk orifice member 34 contains a central conical dimple 42 having exactly two orifices 44, 46 diametrically opposite each other and equidistant from the main longitudinal axis 14 of the injector. When the fuel injector is operated open, the pressurized fuel that is supplied to the injector via the inlet 16 is ejected from the nozzle 18 in two distinctly divergent directions, a split stream, represented generally by the respective numerals 48, 50 in FIG. 2. The construction of the injector and its nozzle end which has thus far been described is generally like that disclosed in certain commonly assigned issued patents, and therefore will not be described further at this time so that attention can be focused on the inventive features residing in the air assist atomizer 12 and its association with the fuel injector 10.

The air assist atomizer comprises two parts in assembly relation with the fuel injector: one part being a shroud 52 and the other being an insert disk 54. The shroud 52 possesses a general cap shape having a side wall 56 and an end wall 58. The side wall 56 has a circular cylindrical inside diameter including a shoulder 60 that divides it into a larger diameter portion 62 and a smaller diameter portion 64. The smaller diameter portion 64 extends from immediate contiguousness with the end wall 58 to the shoulder 60 while the larger diameter portion 62 extends from the shoulder 60 to the end of the shroud 52 that is opposite the end wall 58.

A portion of the housing 28 has a nominally circular outside diameter 66 that is dimensioned to allow the larger diameter portion 62 of the shroud 52 to snugly fit onto it. However, that nominally circular outside diameter 66 is provided with one or more interruptions, such as an axial flat or slot 68, so as to thereby cooperatively define with the shroud's side wall 56 the entrance portion of an axially extending passage means 70 for assist air to flow axially along the outside of the housing 28 toward the nozzle 18. The small arrows in FIG. 2 represent the assist air flow.

The end wall 58 extends radially inwardly from the side wall 56 to provide an axially frustoconically expanding aperture 72 which is coaxial with the axis 14 and through which fuel that has just been ejected from the nozzle 18 passes. A raised circular annular ledge 74 is fashioned on the inside of the end wall 58 in circumscription of the frustoconical aperture 72. The insert disk 54 is disposed axially between the nozzle 18 and the end wall 58 and is in fact held between the ledge 74 and the exterior axial end face of the retainer member 36.

The disk 54 has a central circular aperture 76 located on its axis of rotation 14. The aperture is bounded by a first annulus 78 that encircles and is spaced from the dual split stream axes 48, 50 as they pass through the plane formed by one 79 of the flat surfaces of the disk.

Extending through the first annulus and in a direction away from said axis of rotation are six spaced circumferential discontinuities 80*a–d* and 92*a–b*. The discontinuities are divided into three sets. A first set of two 80*a*, 80*b* of the angularly spaced adjacent discontinuities is aligned along imaginary lines 81*a*, 81*b* extending through the axis 48 of one of the fluid flow streams The imaginary lines are equally spaced A° from a diameter 84 which passes through the axes 48, 50 of the fluid flow streams. In the preferred embodiment, this is an angle of sixty degrees. A second set of two of the angularly spaced adjacent discontinuities 80*c*, 80*d* is aligned along imaginary lines 81*c*, 81*d* extending through the axis 50 of the other of the fluid flow stream. The remaining two discontinuities 92*a*, 92*b* being diametrically opposed and aligned along a diameter 94 normal to and bisecting the diameter 84 passing through the axes 48, 50 of the fluid flow streams.

Figure 5:
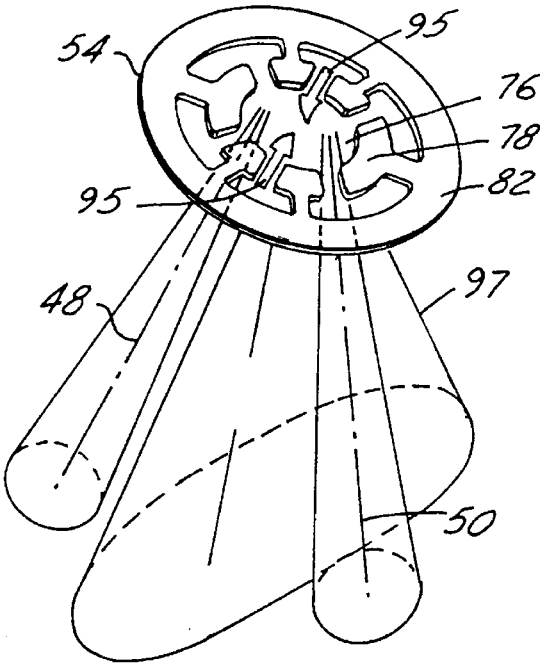
FIG. 5 is a pictorial view of the spray pattern with the air in all 6 channels.
Figure 6:
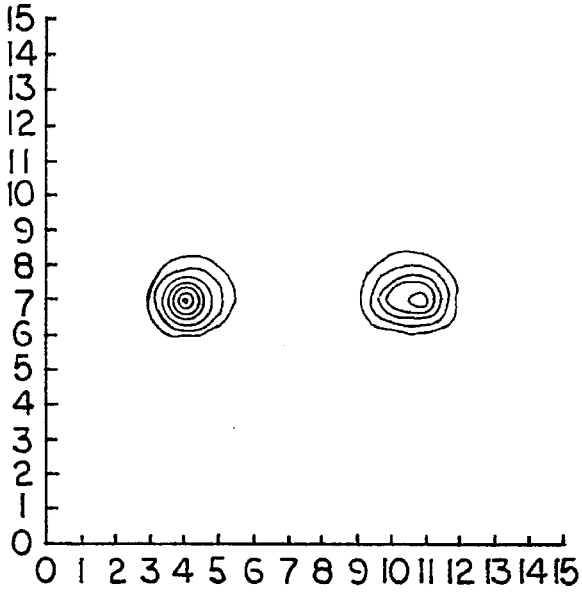
FIG. 6 is the effective spray pattern without air.
Figure 7:
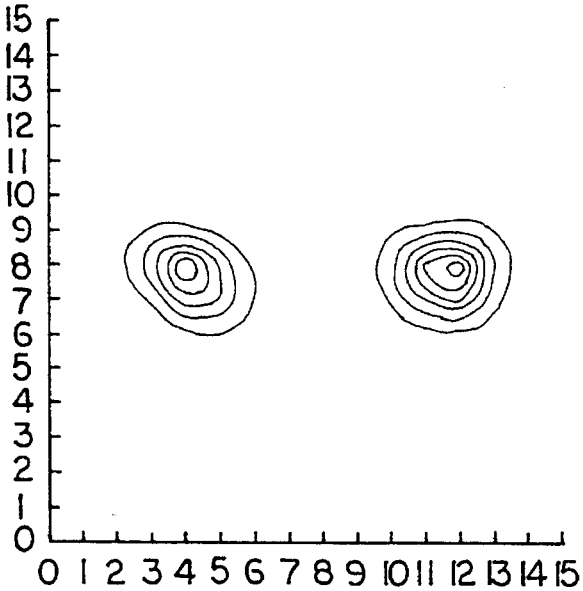
FIG. 7 is the effective spray pattern with air.

A second annulus 82 located around the periphery of the disk and functions as the outer boundary of six openings 86. Each opening is bounded by the first and second annuli and is connected to one of the discontinuities. The openings are in fluid contact with the passageway in the shroud and is adapted to receive assist air from the passageway;

The two diametrically opposed discontinuities 92*a*, 92*b* receive air from the passageway for forming an air curtain 97 between the fluid flow streams. The air curtain maintains a substantial separation of the two streams as illustrated in FIGS. 5–7. The other four discontinuities 80*a–d* direct assist air into the fluid flow streams as illustrated in FIGS. 5–7.

The outside diameter (O.D.) of the insert 54 is dimensioned just slightly less than the inside diameter (I.D.) of the side wall portion 64 to allow the insert to pass axially through the shroud so that it can be disposed against the inside of the end wall 58 preparatory to assembling the atomizer to the fuel injector. In this way, the annulus 82 functions as a locator to properly center, i.e. radially locate, the insert within the shroud. Such placement serves to dispose the annulus 78 on the ledge 74 so that when the insert-containing shroud is thereafter assembled onto the nozzle by advancing the shroud over the end of the housing 28, the annulus 78 will be sandwiched between and in mutual abutment with the ledge 74 and the annular end surface of the retainer member 36, as appears in FIGS. 1 and 2.

Figure 4:
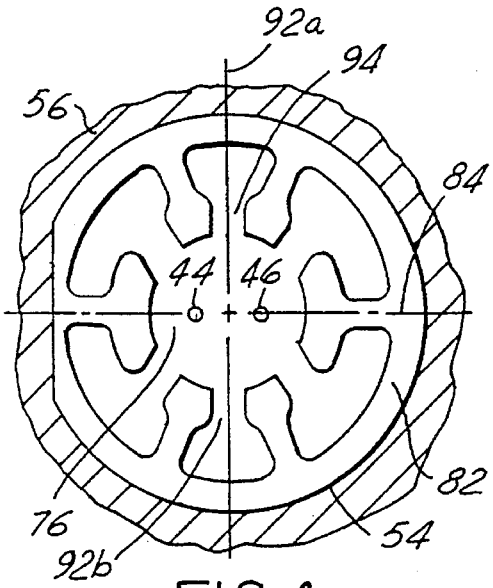
FIG. 4 is a partial sectional view taken along line 4—4 of FIG. 2 illustrating the locator for the disk of FIG. 3 in relation to the split stream orifices.

The insert 54 can be fabricated by a stamping process from sheet material such as stainless steel. The insert 54 is flat and of uniform thickness throughout, so that the overall axial dimension that is equal to its thickness. As illustrated in FIG. 4, the insert 54 has an express provision, a flat 88, for securing circumferential registry with a corresponding flat 90 in the shroud 52. Alternatively, it is possible to secure proper circumferential registry without such a flat surface. In such case, the insert is properly circumferentially oriented on the shroud prior to assembling the shroud over the end of the nozzle. Such circumferential registry is important wherein the thin disk orifice member 34 has two or more orifices for a split stream application. This is because it is deemed preferable to align diametrically opposite openings 92*a–b* in the insert 54 on a common diameter 94 perpendicular to a common diameter 84 between orifices 44 and 46.

A illustrated in FIG. 5, the diametrically opposite openings 92 on the common diameter 94 function to direct the flow of air across the circular aperture 76 as illustrated by arrows 95. This air functions to prevent air from other openings 80*a–d*, from extending beyond the stream of fuel being ejected from either orifice 44 and 46. The fuel flows along the two axis 48 and 50 from their respective orifices 44 and 46. The air curtain is shown keeping the air assisted fuel apart fuel flows. FIGS. 6 and 7 illustrated the flow from the injector 10 without air in FIG. 6 and with air in FIG. 7. Without air, the cones of fuel are relatively tight and form a tight circular pattern. However with the air flowing in each of the six channels, the circular pattern is broader, but the air curtain 97 formed by the air flowing in the direction of the arrows 95 in FIG. 5 keep the fuel cones apart as illustrated in FIG. 7.

The atomizer-equipped fuel injector 10 is adapted to be installed in a manifold (not shown) that delivers assist air to the open upstream end of a passage means 70. Axially spaced apart O-rings 98, 100 on the outside of the housing 28 and the outside of the shroud 52 provide for sealing of the atomizer-equipped fuel injector to a socket in the manifold for receiving the injector.

In use, the air atomizer promotes the atomization of fuel being ejected. In the case of the illustrated fuel injector, the injections along the directions 48, 50 will be nebulized by the atomizer into the shape of respective clouds, as distinguished from narrower streams.

What is claimed is:

1. An air-assisted fuel injector having a nozzle with a dual split stream thin edge orifice disk for metering fuel from the injector along two divergent axes, a substantially tubular shroud located around the nozzle, said shroud having an axially extending passageway for directing assist air to flow along the outside of said nozzle, an end wall radially extending from side wall for directing the assist air to an aperture in the end wall and a disk means spaced from the orifice disk and located between the end wall and bottom of the nozzle, the disk means comprising:

a central circular aperture located on the axis of said disk means, said aperture bounded by a first annulus that encircles and is spaced from the dual split stream axes as they pass through the plane formed by one of the surfaces of said disk;

six spaced circumferential discontinuities extending through said first annulus and in a direction away from said axis, a first set of two angularly spaced adjacent discontinuities aligned along imaginary lines extending through the axis of one of the fluid flow streams, a second set of two angularly spaced adjacent said discontinuities aligned along imaginary lines extending through the axis of the other of the fluid flow streams and remaining two said discontinuities being diametrically opposed and aligned along a diameter normal to and bisecting a diameter passing through the axes of the fluid flow streams;

a second annulus located around the periphery of the disk;

six openings bounded by the first and second annuli, each of said openings connected to one of said discontinuities and adapted to receive assist air from the passageway;

said two diametrically opposed discontinuities for forming an air curtain between the fluid flow streams maintaining substantial separation of the streams and said other four discontinuities for directing assist air into the fluid flow streams.

2. An air-assisted fuel injector as set forth in claim 1 in which said first annulus is circular in shape.

3. An air-assisted fuel injector as set forth in claim 1 in which the entirety of said disk is flat and planar throughout such that the overall axial dimension of said disk is equal to its thickness.

4. An air-assisted fuel injector as set forth in claim 1 in which said disk comprises a locating means integral with said first annulus and coacting with said shroud for radially locating said annulus.

5. An air-assisted fuel injector as set forth in claim 4 in which said locating means comprises a flat that is integral with said first annulus and normal to said diameter passing through the axes of the fluid flow streams and coacting with the side wall of the shroud for locating said disk relative to the dual split stream thin edge orifices.

6. An air-assisted fuel injector as set forth in claim 1 in which said second annulus is circumferentially continuous.

7. An air-assisted fuel injector as set forth in claim 6 in which said second annulus and said first-mentioned annulus are both circular in shape and are disposed in a common plane.

8. An air-assisted fuel injector as set forth in claim 7 in which the entirety of said disk is flat and planar throughout such that the overall axial dimension of said disk is equal to its thickness.

9. An air-assisted fuel injector as set forth in claim 1 in which said end wall comprises an internal raised ledge against which said first annulus abuts.

* * * * *